United States Patent [19]

Schuettenberg

[11] Patent Number: 4,505,725

[45] Date of Patent: Mar. 19, 1985

[54] FUEL ADDITIVES FROM BORATED, ACID-TREATED MIXTURES OF VEGETABLE OIL DERIVED AMIDES AND ESTERS

[75] Inventor: Alexander D. Schuettenberg, Bartlesville, Okla.

[73] Assignee: Phillips Petroleum Company, Bartlesville, Okla.

[21] Appl. No.: 572,268

[22] Filed: Jan. 20, 1984

[51] Int. Cl.[3] ..... C10L 1/30

[52] U.S. Cl. ..... 44/66; 44/71; 260/404.5; 44/66

[58] Field of Search ..... 44/71, 76, 66; 260/404.5

[56] References Cited

U.S. PATENT DOCUMENTS

| | | | |
|---|---|---|---|
| 3,322,670 | 5/1967 | Burt et al. | 252/49.6 |
| 3,338,834 | 8/1967 | Abbott | 252/49.6 |
| 4,249,912 | 2/1981 | Holtz et al. | 44/71 |
| 4,269,606 | 5/1981 | Bonazza et al. | 44/71 |
| 4,344,771 | 8/1982 | Bonazza et al. | 44/63 |

*Primary Examiner*—Y. Harris-Smith

*Attorney, Agent, or Firm*—A. W. Umphlett

[57] ABSTRACT

Vegetable oils, particularly soy oil, are reacted with polyamines, particularly tetraethylenepentamine, to form a mixture containing amides, imides, half esters and glycerol; subsequent reaction with sulfonic acid to produce a product mix that is further reacted with a boron-containing compound, particularly boric acid, to provide a fuel additive that has good detergent properties and is particularly non-corrosive.

14 Claims, No Drawings

FUEL ADDITIVES FROM BORATED, ACID-TREATED MIXTURES OF VEGETABLE OIL DERIVED AMIDES AND ESTERS

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to fuel detergent additives for use in hydrocarbon fuel in internal combustion engines. In yet another aspect of the invention it relates to mixtures containing a plurality of different functional moieties combining to produce superior qualities for fuel detergents.

With the advent of pollution standards for automobile exhaust it became important that the fuel additives not contain metal ions that tend to poison the catalyst in automotive engine exhaust converter systems. One of the better fuel and lubricant additives that was developed to replace additives containing metal ions was an acid-treated mixture of vegetable oil derived from amides and esters that were set out in U.S. Pat. No. 4,344,771. The product was particularly economically attractive because it was based on readily available vegetable oils.

It has now been found that by further treating the acid-treated mixtures of vegetable oil derived from amides and esters as set out in U.S. Pat. No. 4,344,771 with a compound that will introduce boron into the additive molecule that a fuel additive can be obtained that has improved anti-corrosive properties as compared to the additives not containing the boron and that otherwise have fuel additive characteristics that are at least equal to the additives that do not contain the boron.

It is therefore an object of this invention to provide additive mixtures for internal combustion engine fuels containing multiple detergent functionalities. It is another object of this invention to provide a method for producing detergent additives for internal combustion fuels. It is still another object of this invention to provide a detergent fuel composition combining a fuel detergent additive with a hydrocarbon suitable for use as fuel in an internal combustion engine. It is still another object of this invention to provide a fuel additive of improved anti-corrosive characteristics as compared to the acid-treated mixture of vegetable oil derived from amides and esters as set out in U.S. Pat. No. 4,344,771.

Other aspects, objects and the various advantages of this invention will become apparent upon reading the specification and the appended claims.

STATEMENT OF THE INVENTION

A method is provided for producing a detergent additive for fuels combining multiple detergent functionalities in a product mixture by (1) reacting a vegetable oil with multiamine to produce a product mixture that is (2) further reacted with sulfonic acid to produce a second product mixture that is (3) still further reacted with a boron-containing compound, preferably boric acid.

A product mixture suitable as a detergent additive for fuels is provided which is a composition of matter prepared by (1) reacting a vegetable oil with multiamine to produce a product mixture that is (2) further reacted with sulfonic acid to provide a second product mixture that is (3) further reacted with a boron-containing compound, preferably boric acid.

In a further embodiment of the invention a method is provided for reducing engine deposits in an internal combustion engine comprising the addition of a detergent fuel additive package having as a component a detergent additive which is a composition of matter prepared by the reacting of boron-containing compound, preferably boric acid, with a product mixture from the sulfonic acid treatment of vegetable oil derived from amines and esters.

The preparation of the acid-treated mixture of vegetable oil derived from amides and esters useful in the present invention is, as stated above, set out in U.S. Pat. No. 4,344,771, which is incorporated here by reference. The following sets out the preparation of these compositions.

The vegetable oils may be selected from those commonly available such as cottonseed oil, peanut oil, soybean oil, corn oil, rapeseed oil, coconut oil, etc. These are mainly triglycerides of long-chain monocarboxylic acids such as lauric, myristic, stearic, palmitic, palmitoleic, oleic, linoleic, etc., i.e., acids containing 10–25 carbon atoms:

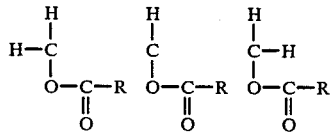

where R is an aliphatic radical of 10–25 carbon atoms.

Generally, vegetable oils contain glycerides of a number of acids, the number and kind varying with the source of vegetable for the oil.

Among the multiamines that are suitable for use in this invention are those having the general formula $H_2N(CH_2CH_2NH)_xH$ where x is an integer between 2–10, preferably 3–6. Representative multiamines are ethylenediamine (EDA), tetraethylenepentamine (TEPA), pentaethylenehexamine (PEHA), etc. Mixtures of multiamines may be used. Polyethylenimine, among the amines preferred for use in this invention, is representative of a more complex group of multiamines. The preferred multiamine for use in this invention is TEPA.

The amounts of vegetable oil and multiamine employed can be expressed in terms of the molar ratio of triglyceride to nitrogen (N). Broadly, the ratio is from about 0.05:1 to 1.00:1 and preferably is from about 0.13:1 to about 0.80:1.

The first reaction, which is between the oil and a multiamine, results in a product that is a mixture of glycerol, glycerol partly esterified (mono and diglycerides), and amides and imidazolines of the fatty acids, e.g.,

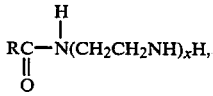

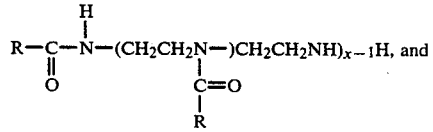

-continued

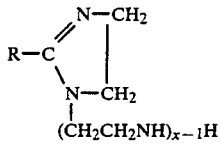

wherein x is defined as above. Reaction conditions for the first reaction are: temperature within the range of about 35° C. to about 260° C., preferably from about 120° C. to about 200° C., for a time of about 1 to about 16 hours, preferably about 4 to about 9 hours which can be carried out at atmospheric pressure, but is generally conducted at 0–50 psig when no diluent is present. If a diluent is employed the pressure is usually that produced by the vapor pressure of the diluent at the temperature employed. It is also preferable to utilize an inert atmosphere such as nitrogen over the reaction mixture.

Treatment of the products of the first reaction with a strong acid, i.e., a sulfonic acid, produces additives with good detergency as set out in U.S. Pat. No. 4,344,771. Suitable sulfonic acids have the general formula $R'SO_3H$ where R' is alkyl, aryl, alkaryl and cycloalkyl with 6–100 carbon atoms. Typically, dodecylbenzene sulfonic acid, octadecyl sulfonic acid, dodecyl sulfonic acid, and sulfonic acid oil can be used. The sulfonic acid mixtures obtained by treating lubricating stock with sulfur trioxide, "mahogany" acid, etc., are also suitable for use in the second reaction.

The treatment of products of the first reaction with a strong acid is a neutralization reaction which takes place at atmospheric pressure. The reaction mixture requires stirring until homogeneity is achieved which usually requires from about 1 to about 300 minutes, more generally about 60 to about 120 minutes, with heat applied mostly for the purpose of reducing viscosity. The temperature is generally controlled within the range of about 25° C. to about 100° C., preferably about 40° C. to about 70° C.

The acid reacts preferentially with the amino groups remaining in the multiamines after the first reaction.

In the third reaction the acid-treated mixture of vegetable oil derived from amides and esters prepared in the second reaction is further reacted with a boron-containing compound suitable for adding boron into the additive molecule. Among the compounds suitable are boric acid, ethyl borate, propyl borate, and n-butyl borate. The preferred compound is boric acid.

The treatment of products of the second reaction with the boron-containing compound requires stirring of the reaction mixture for a period of time ranging from about 10 to about 450 minutes, more generally from about 240 to about 360 minutes, with heat applied within a range of about 90° C. to about 130° C., preferably from about 100° C. to about 120° C. The product can contain 2,000 to 100,000 ppm boron. Preferably the product contains 4,000 to 20,000 ppm boron.

Normally liquid hydrocarbon diluents can be utilized in any or all of the reactions. It is also possible to strip the diluent from the products of any or all of the reactions and replace it with a different diluent. Hydrocarbon diluents useful in the above reaction can include aromatic hydrocarbons of 6 to about 10 carbon atoms per molecule such a benzene, toluene, the xylenes, or mixtures thereof. Lube stocks such as solvent refined paraffinic oils can also be used as diluents. Such hydrocarbon diluents, if employed, need not be separated from the final product but can serve as solvent or carrier for the detergent additive to provide a convenient method of handling the additive when blending with fuel or lubricant stocks.

The final product is complex. The distribution of possible reaction products depends on the ratio of vegetable oil to multiamine. In the treatment with strong acid a large excess of the strong acid should be avoided because it is preferred to have a product with a pH greater than about 6.

The detergent additive that is the final product is used at about 1 to about 100 pounds/1000 barrels of fuel to prevent harmful carburetor and intake system deposits. The fuel can be any hydrocarbon useful as an internal combustion engine fuel, preferably hydrocarbon mixtures used in commercial fuel blends.

As noted above, it is convenient to handle the detergent additive in a solvent, i.e., a carrier or vehicle, to provide an additive package for use in blending the additive with fuels or lubricant stocks. It is generally considered beneficial to include a minor amount of material which has demulsifier properties in the additive package in the present invention. Such a component, though preferred, is not essential to the deposit-inhibiting affect of the additives of the present invention. Any material which is compatible with motor fuels and which exhibits demulsification properties when utilized at relatively low levels such as 0.1–10, preferably 0.5–5, percent by weight, based on the weight of the additive in the additive package can be used. Due to the low dosage of such material, it has no tendency to interfere with the deposit-inhibiting effects of the additive or the combustion characteristics of the motor fuel.

Among the demulsifying agents suitable for use in the present invention, but not limited thereto, are the oxyalkylated alkylphenol formaldehyde polymers as disclosed in U.S. Pat. Nos. 2,499,367, 3,424,565, and 3,752,657.

The amount of solvent used in forming the additive package can vary widely with the lower end of the range being the minimum amount of solvent required to keep the additive and/or demulsifier solution under conditions encountered in handling or storage. The upper end of the solvent content for the additive package is usually governed by considerations of economy. Solvent content can range as high as about 95% by weight based on the total additive package, but will generally be in a range from about 20 to about 80 weight percent. The additives of this invention, like those of U.S. Pat. No. 4,344,771 should also be found to be useful with lubricant stocks, particularly solvent refined, paraffinic lubricant stock having a viscosity index of 100 or above and a Saybolt viscosity of 210° F. in the range of about 39 to about 100 SUS, preferably about 45 to about 75 SUS. Additives prepared using the higher molecular weight sulfonic acids ($R'NR'SO_3H$=50–100 carbon atoms) are especially attractive for use as lubricant stocks due to their higher oil solubility. Other additives commonly used in formulating lubricants, such as viscosity index improvers, antioxidants, and the like can be used in formulation with the additives of this invention without destroying the effectiveness of the additives.

The example below is meant to be illustrative and should not be taken as restrictive.

EXAMPLE I

Refined soybean oil (2870 g) and tetraethylenepentamine (TEPA) (614.3 g) were combined in a 3-neck 5 liter flask, stirred and heated at 176° C. for 8 hours under a nitrogen atmosphere. This afforded the soya/-TEPA product.

The soya/TEPA product (2500 g) from the above reaction was combined with 1769.5 g of acid oil (a sulfonic acid obtained from the reaction of sulfur trioxide with a lubricating bright stock), stirred and heated for one hour at 74° C.

The product of this reaction was mixed in an amount of 160 g with 240 grams HP-7 solvent which is mostly toluene to reduce the viscosity of the active detergent, making it more convenient to mix with other organic materials.

To the above detergent solution were added various amounts of boric acid, $H_3BO_3$ as shown in the table below. This was stirred under a nitrogen atmosphere for 5 hours while being heated to 110° C. A water-cooled condensor kept the mixture at reflux temperature. A Dean-Stark trap was used to collect water product which indicated reaction of the acid with the detergent. Approximately 100 g HP-7 solvent was added to the product mixture. This was filtered and the filtrate was condensed in vacuo to about 400 g diluted product. The product was subjected to elemental analysis to determine the amount of boron in each of the sample compounds. The results are shown in Table I for samples 1–6.

The samples prepared as shown above were subjected to a series of tests in a fuel recipe at the additive concentration listed.

1. NACE test, modified ASTM D665
2. Thin layer chromotography test (TLC) for detergency
3. "Falcon Engine Test"

In the "Falcon Engine Test" a premium base unleaded gasoline containing no other additives was used as the base fuel for samples 1–6. These test fuels were used to power a 170 CID 6-cylinder Falcon engine. The engine was run for 23 hours at 1800 rpm and 11.4 bhp with continuous, noncyclic operation. About 0.5 cubic feet per minute ambient air was introduced through PCV valve below the carburetor and 3.2 cubic feet per minute of exhaust gas was circulated unfiltered through the carburetor throttle board. Intake air was filtered through the standard filter element. An SAE 10W-40 motor oil was used with the oil sump temperature maintained at 216° plus or minus 4° F. The temperature of coolant out was maintained at 196° plus or minus 5° F. and the intake air temperature was varied to control the temperature above the carburetor sleeve at 150° plus or minus 2° F. The fuel flow was maintained at about 1.5 gallons per hour with the air/fuel ratio checked periodically but not controlled and the intake manifold vacuum recorded but not controlled. The performance of a fuel or additive in this test was evaluated on the basis of deposits formed on a removable aluminum sleeve in the carburetor throat. Three or four differential weights were obtained between the weight of the sleeve at the start of the test and the weights after the test: (1) unwashed, and (2) n-heptane washed. Visual ratings of deposits were not used in the evaluation. The results of the evaluation of the control and test runs are tabulated below.

The TLC test procedure used in evaluating these fuel additives was as follows: Whatman No. 2 filter paper was cut into rectangular strips approximately 3.8 by 7.6 cm and marked with a pencil at a distance of 5.1 cm from the base edge. Carburetor type deposits obtained from a modified Falcon engine detergency test were applied in each strip in chloroform solution (0.5 μl) with a capillary drawn from a melting point tube as a spot (~1 mm in diameter) 9 mm from the base of the strip. To develope a chromatogram, a strip was placed spotted end down in an Eastman Chromagram developing-jar (No. 13256) containing a solution of detergent in toluene, making sure that the spot is above the liquid level in the jar. The elution of the strip was allowed to proceed until the solvent front reached the mark at the top of the strip, at which time the developed chromatogram was removed from the jar, dried, and rated. A rating scale of 4 to 10 based upon how well the detergent moves the spot was used to represent very poor detergency to excellent detergency characteristics. Approximately 10 to 15 minutes were required for each determination.

The results shown below point out that samples 1–6 which contain various amounts of boron provided about the same results for the "Falcon Engine Test" and the TLC, but provided a definite improvement in the results of the NACE tests. The results are set out in Table I below.

TABLE I

| Sample | ppmB in Cpd.** | NACE Test % Coupon Covered With Rust | TLC | Falcon Engine* Test % Improvement |
|---|---|---|---|---|
| 1 | 1900 | 15–20 | 9 | 87 |
| 2 | 3950 | 5–10 | 9 | 83 |
| 3 | 7600 | <5 | 8 | 86 |
| 4 | 19000 | 5–10 | 8 | 86 |
| 5 | 40500 | 5–10 | 7 | 77 |
| 6 | 49250 | 5–10 | 8 | 89 |
| 7[a] | 0 | 15–20 | 9 | 82 |
| 8[b] | 0 | 40–50 | c | c |

[a]Phil-Ad CD-40 as an additive but without reaction to add boron to the product of reacting sulfonic acid with the reaction product of vegetable oil and tetraethylenepentamine.
[b]gasoline stock with no additive.
[c]not tested.
*conc of sample in gasoline = 10 pounds per 1000 bbl gasoline.
**expressed as boron concentration in product without diluent.

I claim:

1. A composition useful as a detergent additive for fuels comprising the reaction product prepared by reacting multiamine with vegetable oil to obtain a first product mixture, said vegetable oil selected from triglycerides of long-chain monocarboxylic acids of the formula

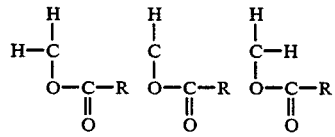

where R is an aliphatic radical of 10 to about 25 carbon atoms, said first product mixture further reacted with sulfonic acid to obtain a second product mixture and said second product mixture further reacted with a boron-containing suitable to provide a boron content of about 2000 to about 100,000 ppm in a final product.

2. A composition of claim 1 wherein the multiamines have the general formula $H_2N(CH_2CH_2NH)_xH$ where x is an integer between 2 and 10.

3. The composition of claim 1 wherein said vegetable oils are selected from among the group consisting of cottonseed oil, peanut oil, soybean oil, corn oil, rapeseed oil, and coconut oil.

4. A composition of claim 2 wherein the vegetable oil is soybean oil.

5. A composition of claim 4 wherein the multiamine is tetraethylenepentamine.

6. A composition of claim 5 wherein the boron-containing compound is boric acid.

7. A method for producing a detergent additive composition useful in the treatment of fuels comprising:

reacting multiamine with vegetable oil to obtain a first product mixture, said vegetable oil selected from among triglycerides of long-chain monocarboxylic acids of the formula

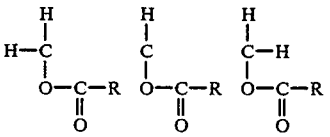

wherein R is an aliphatic radical of about 10 to about 25 carbon atoms, further reacting said first product mixture with sulfonic acid to obtain a second product mixture and further reacting said second product mixture with a boron-containing suitable to provide a boron content of about 2000 to about 100,000 ppm in a final product.

8. A method of claim 7 wherein the multiamines have the general formula $H_2N(CH_2CH_2NH)_xH$ where x is an integer between 2 and 10.

9. A method of claim 7 wherein said vegetable oils are selected from among the group consisting of cottonseed oil, peanut oil, soybean oil, corn oil, rapeseed oil, and coconut oil.

10. A method of claim 8 wherein the vegetable oil is soybean oil.

11. A method of claim 10 wherein the multiamine is tetraethylenepentamine.

12. A method of claim 11 wherein the boron-containing compound is boric acid.

13. A method for reducing engine deposits in an internal combustion engine comprising the addition of a detergent fuel additive package comprising the composition of claim 1 to the hydrocarbon fuel for the engine, said fuel detergent being added in an amount effective to reduce carbon deposits and using said hydrocarbon fuel with fuel detergent additive as fuel in an internal combustion engine.

14. A method for reducing engine deposits in an internal combustion engine comprising the addition of a detergent fuel additive package comprising the detergent additive prepared by the method of claim 7 as a hydrocarbon fuel for the engine, said fuel detergent being added in an amount effective to reduce engine deposits and using said hydrocarbon fuel with fuel detergent additive as a fuel in an internal combustion engine.

* * * * *

UNITED STATES PATENT AND TRADEMARK OFFICE

CERTIFICATE OF CORRECTION

PATENT NO. : 4,505,725

DATED : March 19, 1985

INVENTOR(S) : Alexander D. Schuettenberg

It is certified that error appears in the above-identified patent and that said Letters Patent is hereby corrected as shown below:

Claim 7 (last line of column 7),"boron-containing suitable" should be --boron-containing compound suitable--.

Signed and Sealed this

*Thirteenth* Day of *August 1985*

[SEAL]

*Attest:*

DONALD J. QUIGG

*Attesting Officer* *Acting Commissioner of Patents and Trademarks*